US008731951B2

(12) United States Patent
Choi et al.

(10) Patent No.: US 8,731,951 B2
(45) Date of Patent: May 20, 2014

(54) VARIABLE ORDER SHORT-TERM PREDICTOR

(75) Inventors: Byeong Ho Choi, Yongin-si (KR); Dong Sun Kim, Seongnam-si (KR); Je Woo Kim, Seongnam-si (KR); Choong Sang Cho, Seongnam-si (KR); Seung Yerl Lee, Seongnam-si (KR); Sang Seol Lee, Incheon (KR)

(73) Assignee: Korea Electronics Technology Institute, Seongnam-si (KR)

( * ) Notice: Subject to any disclaimer, the term of this patent is extended or adjusted under 35 U.S.C. 154(b) by 148 days.

(21) Appl. No.: 13/339,951

(22) Filed: Dec. 29, 2011

(65) Prior Publication Data

US 2012/0173246 A1 Jul. 5, 2012

(30) Foreign Application Priority Data

Dec. 31, 2010 (KR) ..... 10-2010-0139903

(51) Int. Cl.
*G10L 19/00* (2013.01)

(52) U.S. Cl.
USPC ..... 704/500

(58) Field of Classification Search
CPC ..... G10L 19/0017
USPC ..... 704/500
See application file for complete search history.

(56) References Cited

U.S. PATENT DOCUMENTS 5,884,269 A 3/1999 Cellier et al.
2010/0027625 A1 * 2/2010 Wik et al. ..... 375/240.12

FOREIGN PATENT DOCUMENTS

KR 10-2009-0101730 A 9/2009
KR 10-2004-0045287 A 12/2010

OTHER PUBLICATIONS

Liechen et al., The MPEG-4 Audio Lossless Coding (ALS) Standard—Technology and Applications, Oct. 7-10, 2005 Audio Engineering Society, 1-14.*
Lindahal et al., A Low-Powe FIR using Combined Residue and Radix-2 Signed-Digit Representation, 2005, IEEE, 2005.*
Choong Sang Cho et al., "Implementation of an object audio system based on MPEG-4 audio lossless coding on DSP", p. 1-5.
Tilman Leibchen et al., "The MPEG-4 Audio Lossless Coding (ALS) Standard-Technology and Applications", Audio Engineering Society Convention Paper, Oct. 7-10, 2005, AES 119th Convention, New York, NY, USA (p. 1-14).

* cited by examiner

*Primary Examiner* — Jakieda Jackson
(74) *Attorney, Agent, or Firm* — Sughrue Mion, PLLC

(57) ABSTRACT

The present invention provides a new recursive FIR filter scheme which supports a variable order short-term predictor, and uses a pipeline stall based on the radix-2 algorithm and an autocorrelation processing time for reducing the complexity of MPEG-4 ALS hardware implementation.

5 Claims, 3 Drawing Sheets

VARIABLE ORDER SHORT-TERM PREDICTOR

CROSS-REFERENCE TO RELATED APPLICATIONS

This application claims priority under 35 U.S.C. §119 to Korean Patent Application No. 10-2010-0139903, filed on Dec. 31, 2010, the disclosure of which is incorporated herein by reference in its entirety.

TECHNICAL FIELD

The present disclosure relates to a variable order short-term predictor, and more particularly, to a variable order short-term predictor, which uses a recursive Finite Impulse Response (FIR) filter scheme with a pipeline stall based on an autocorrelation processing time and the radix-2 algorithm for reducing the complexity of MPEG-4 Audio Lossless coding (ALS) hardware implementation.

BACKGROUND

Users of multimedia products get more demanding on high-quality audio service, and a lossless audio coding technique has been standardized as MPEG-4 ALS for accommodating the demand of the market.

MPEG-4 ALS consists of two main parts such as forward linear prediction and entropy coding.

In forward linear prediction, the optimal predictor coefficients are usually estimated for each block by the autocorrelation method.

The autocorrelation method may use the Levinson-Durbin algorithm. The autocorrelation method has additionally the advantage of providing a simple means that iteratively adapts the order of the predictor. Such Linear Prediction Coefficients (LPCs) are used for short-term predictors, and generally implemented with an FIR filter.

However, MPEG-4 ALS supports the LPCs order up to 1023 with the bit resolution of 32-bit Pulse Code Modulation (PCM), and the wide range of the filter order highly increases the complexity of short-term predictors. Particularly, the short-term predictors are most complicated in implementing the MPEG-4 ALS encoder.

The processing time of short-term predictors depends on the calculation time of linear prediction filter coefficients, and various architectures have been proposed in order to provide high-speed and area-efficient implementations for the FIR filter based short-term predictor.

However, such architectures do not consider the timing problem and area efficiency in pipeline scheme that have not been perfectly matched in coefficient calculation time of MPEG-4 ALS.

SUMMARY

Accordingly, the present disclosure provides a variable order short-term predictor, which uses a pipeline stall based on an autocorrelation processing time and the radix-2 algorithm for reducing the complexity of MPEG-4 ALS hardware implementation.

In one general aspect, a variable order short-term predictor of an encoder based on the MPEG-4 ALS standard includes: a pre-decision module receiving a prediction order for deciding the number of iterations of a filtering operation to calculate a modified prediction order for deciding the number of modified iterations of the filtering operation; a loop controller outputting a control signal for deciding the number of modified iterations according to the modified prediction order; an FIR filter receiving a sample signal, and iteratively performing the filtering operation on the sample signal; and an output module receiving the control signal and the filtered sample signal, holding an output of the FIR filter according to the control signal when the number of modified iterations is completed, and adding a filtering operation result, obtained per modified iteration number, while the output of the FIR filter is being held to output a finally filtered sample signal according to the control signal.

Other features and aspects will be apparent from the following detailed description, the drawings, and the claims.

DETAILED DESCRIPTION OF EMBODIMENTS

Figure 1:
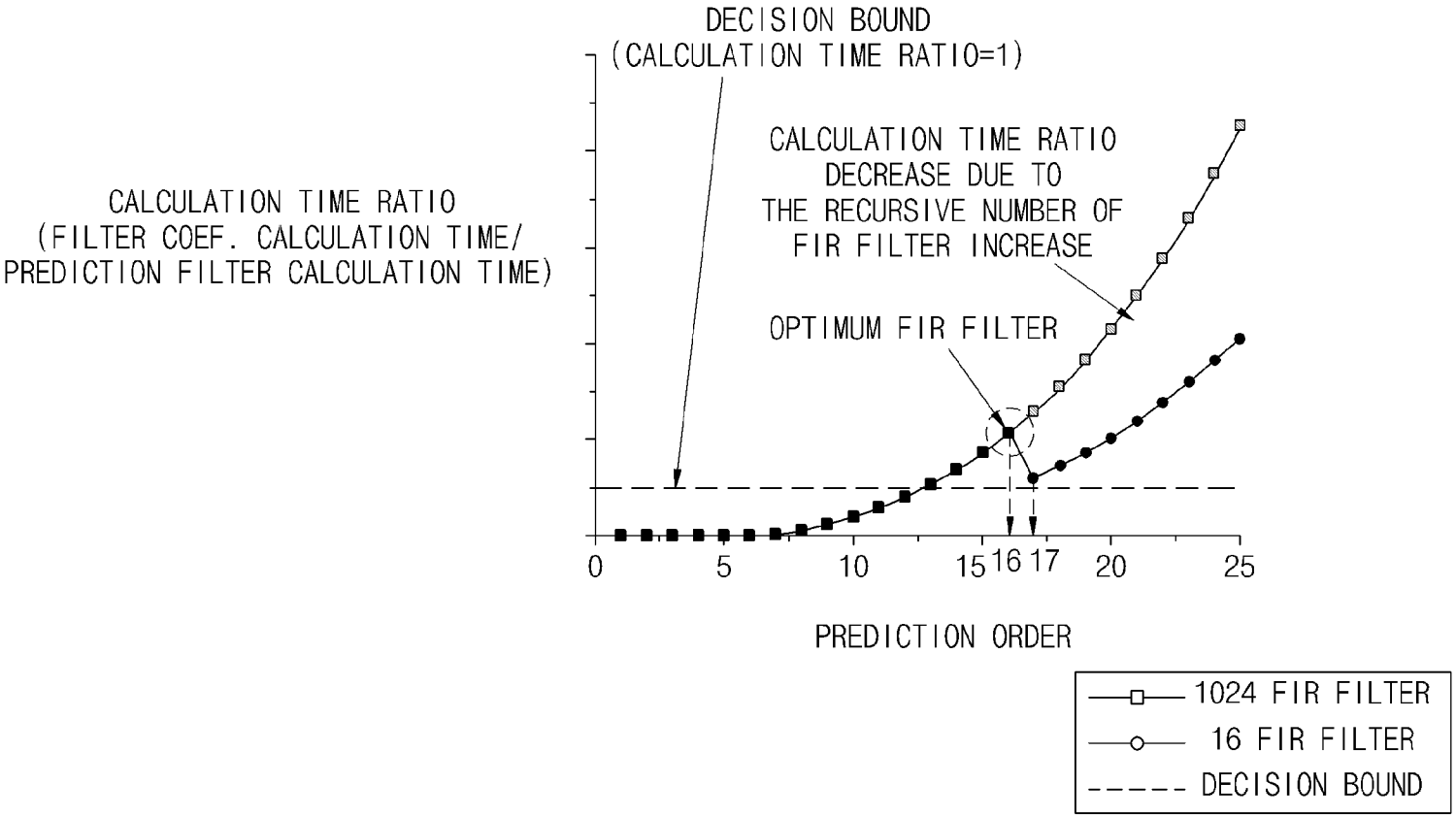
FIG. 1 is a graph showing comparison results of a calculation time ratio for selecting the optimal point of a prediction filter tap applied to an embodiment.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness. The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments will be described in detail with reference to the accompanying drawings.

In an embodiment, a multiplex-based LPC access scheme is proposed for implementing low-complexity MPEG-4 ALS Very Large-Scale Integration (VLSI) and a recursive FIR filter structure using the characteristic of a long LPCs calculation time compared with the FIR filter operation and signal dependency of a short-term predictor calculation block.

A calculation time for an iterative time of FIR filter processing and LPC calculation is considered for deciding an appropriate pipeline control system and a recursive FIR filter architecture.

The processing start time of a short-term predictor depends on the LPCs calculation end time and MPEG-4 ALS encoder needs large number of filter taps for supporting 1024 prediction order. In this reason, pipeline architectures for a short-term predictor have been proposed to use the limited prediction order for high-speed and area-efficient implementations. However these limited prediction order does not satisfy MPEG-4 ALS standard and it decrease the compression ratio of audio data. These architectures also have the pipeline hazard due to the mismatch of coefficient estimation and FIR filter calculation time. To overcome these implementation problems, iterative FIR filter structure and multiplex based LPCs access scheme using the property of long LPCs calculation time compared to the FIR filter operation are proposed for low complexity MPEG-4 ALS encoder hardware. To decide a suitable iterative FIR filter architecture and optimal selection of prediction filter tap, we define the calculation time ratio that is the relative division value of the LPCs calculation and FIR filter processing time. We use clock numbers for deciding LPCs calculation time and these values are easily obtained from MPEG-4 ALS standard. In addition, clock numbers for direct form and radix-2 FIR filter are calculated by using previous work.

FIG. 1 shows comparison results of calculation time ratio for a 1024 tap and a 16 tap FIR filter.

The horizontal dash-dot line in the y-axis of FIG. 1 denotes a decision bound where calculation time ratio is 1 and it means that the filter coefficients calculation time is equal to the FIR filter calculation time. In case of the upper decision bound, LPCs calculation block needs more processing time than FIR filter operation. From this result, we can decide that the optimal number of tap is 16 for recursive FIR filter scheme. Although the recursive scheme using a 16 tap FIR filter increase the calculation time of higher 16 orders as shown in gray color region of FIG. 1, LPCs calculation time is still too long and FIR filter block must be stalled until LPCs calculation is finished. Consequently, short-term predictor for the higher order over 16 can be calculated recursive method. In addition, the proposed recursive FIR filter design is based on the radix-2 algorithm for odd and even order calculation. To apply the modified radix-2 algorithm with recursive parameter L to direct convolution FIR filter, y(n) can be defined as:

$$\text{when } k \geq N,\ h_k = 0,\ L = \left\lceil \frac{N}{T} \right\rceil \tag{1}$$

$$y(n) = \sum_{k=0}^{N-1} h_k x(n-k)$$

$$y(n) = \sum_{l=0}^{L-1} \left( \sum_{k=0}^{T-1} h_{k+Tl} x(n-k-Tl) \right)$$

where a parameter "N" is a prediction order, a parameter "T" is the number of FIR filter taps, a parameter "L" is the number of loops, $h_k$ is a linear prediction coefficient, x(n) is a sample signal, and y(n) is an output of a filter.

By applying the radix-2 algorithm, total complexity per output point is a 3N/4 multiplication and a 3N/4 addition.

Figure 2:
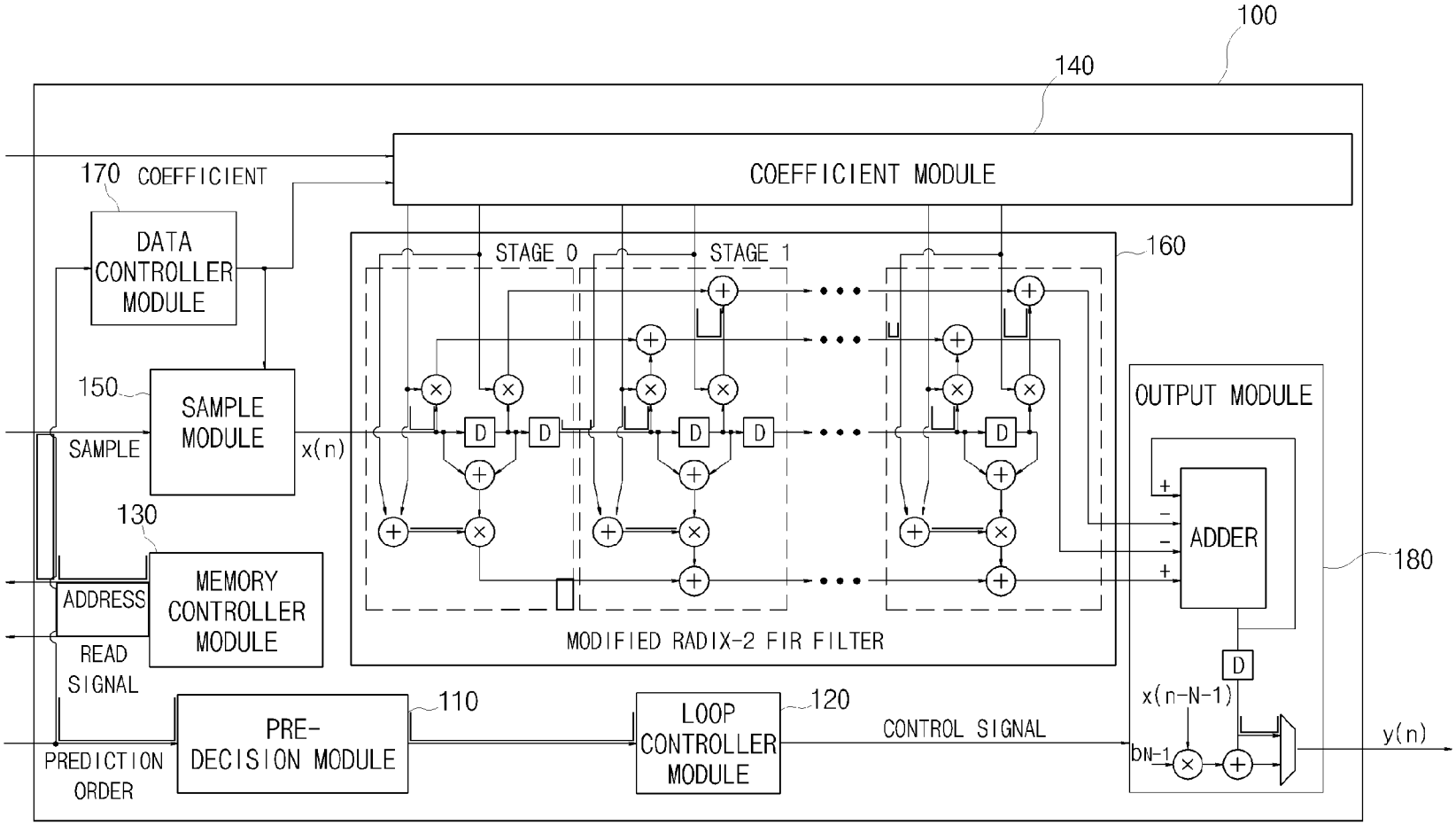
FIG. 2 is a block diagram illustrating a structure of a variable order short-term predictor according to an embodiment.

FIG. 2 is a block diagram illustrating a structure of a variable order short-term predictor according to an embodiment.

Referring to FIG. 2, a variable order short-term predictor 100 according to an embodiment includes a pre-decision module 110, a loop controller module 120, an FIR filter module 160, and an output module 180. The variable order short-term predictor 100 may further include a memory controller module 130, a coefficient module 140 that buffers a coefficient, a sample module 150 that buffers an input sample such as an audio stream, and a data controller module 170.

The pre-decision module 110 is a module that decides the number of iterations of a filtering operation performed by an FIR filter, and receives a prediction order value through a user interface such as a computing apparatus. Herein, the prediction order value is a value that has been defined by the MPEG-4 ALS standard. The pre-decision module 110 computes a prediction order value, defined by the MPEG-4 ALS standard, to calculate a modified prediction order value. The modified prediction order value is a maximum integer value that is obtained by dividing a prediction order, inputted through the user interface, by the optimal number (i.e., sixteen) of taps that have been decided in the description of FIG. 1.

The loop controller module 120 controls an output of the output module 180, and generates a control signal according to the modified prediction order value being the maximum integer value that is obtained by dividing the modified prediction order value (i.e., prediction order), inputted from the pre-decision module 110, by sixteen. The control signal is a signal for deciding the number of iterations of the filtering operation performed by the FIR filter module 160, and allows the output of the output module 180 to be held until the number of iterations of the filtering operation reaches the maximum integer value.

The memory controller module 130 generates an address signal and a read signal for a sample value inputted to the sample module 150 and an appropriate coefficient value that is inputted to the coefficient module 140 for the calculation of the recursive FIR filter.

The recursive architecture and the radix-2 algorithm, modified for low complexity, are applied to the FIR filter module 160. Specifically, the FIR filter module 160 is configured with a plurality of dependently-connected stages. Each of the stages, as illustrated in FIG. 1, is configured with a plurality of multipliers, a plurality of adders, and two delay cells D, for implementing the radix-2 algorithm in hardware.

The FIR filter module 160 (modified radix-2 FIR filter) is configured with eight stages (stage 0 to stage 7), for implementing the radix-2 algorithm in hardware. Herein, when the prediction order is greater than or equal to 17, the short-term predictor 100 is implemented with a 16-tap FIR filter. This is because the FIR filter calculates a residual value by using the recursive FIR filter architecture. To apply the recursive architecture, the loop controller module 120 decides the number of iterations of the filtering operation based on the prediction order.

When the number of iterations of the filtering operation performed by the FIR filter module 160 reaches the maximum integer value, the output module 180 adds a filtering operation result per iteration number while the output of the FIR filter module 160 is being held, and thus outputs y(n) of Equation (1) that is a final operation result.

In this way, the FIR filter module 160 (modified radix-2 FIR filter) with the modified radix-2 algorithm and recursive architecture applied thereto calculates an odd output by using a current even output and a previous even output to generate two outputs, namely, an even output and an odd output simultaneously.

The data controller module 170 controls the coefficient module 140 and the sample module 150 to control the data flow of the coefficient and sample.

Figure 3:
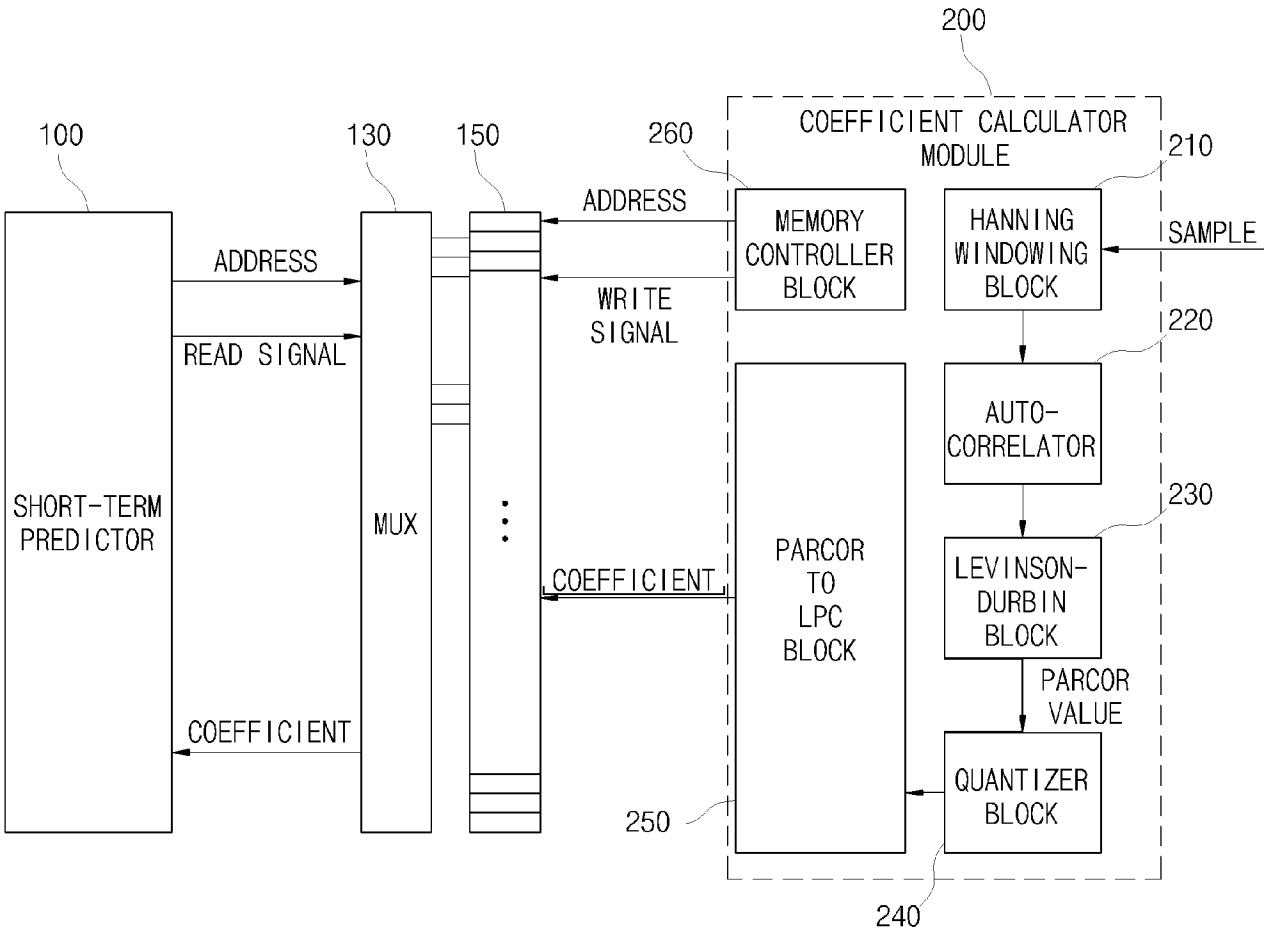
FIG. 3 is a block diagram illustrating an internal configuration of a coefficient calculator module which generates a coefficient value inputted to a coefficient module of FIG. 2.

FIG. 3 is a block diagram illustrating an internal configuration of a coefficient calculator module which is operationally connected to the variable order short-term predictor of FIG. 2.

Referring to FIG. 3, the coefficient calculator module 200 calculates the coefficient value, and supplies the coefficient value to the coefficient module 140 of the variable order short-term predictor of FIG. 2 through a multiplexer (MUX) 130 and a register 150.

The coefficient calculator module 200 includes a harming windowing block 210, an autocorrelator 220, a Levinson-Durbin block 230, a quantizer block 240, a Parcor to LPC block 250, and a memory controller block 260.

The hanning windowing block 210 receives a sample value from the outside, and performs a multiplication operation on the received sample value with a hanning function.

The autocorrelator 220 receives the multiplied result from the hanning windowing block 210, and autocorrelates the multiplied result for generating an input of the Levinson-Durbin block 230.

The Levinson-Durbin block 230 estimates a partial autocorrelation (PARCOR) coefficient value that is less sensitive to an error, based on the Levinson-Durbin algorithm.

The quantizer block 240 quantizes the PARCOR coefficient value from the Levinson-Durbin block 230.

The Parcor to LPC block 250 sequentially stores the quantized PARCOR coefficient values as Linear Prediction Coefficient (LPC) values in the coefficient register 150. The multiplexer 130 selectively outputs the stored LPC values to the variable order short-term predictor 100 according to the address signal and read signal from the short-term predictor 100.

Subsequently, the variable order short-term predictor 100 reads the LPC that is selectively inputted through the multiplexer 130, and thus, the FIR filter module 160 with the recursive FIR filter architecture applied thereto calculates a residual value.

According to the embodiment, complexity can be reduced in implementing MPEG-4 ALS hardware.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A variable order short-term predictor of an encoder based on MPEG-4 Audio Lossless coding (ALS) standard, the variable order short-term predictor comprising:

a pre-decision module receiving a prediction order for deciding the number of iterations of a filtering operation to calculate a modified prediction order for deciding the number of modified iterations of the filtering operation;

a loop controller outputting a control signal for deciding the number of modified iterations according to the modified prediction order;

an FIR filter receiving a sample signal, and iteratively performing the filtering operation on the sample signal; and an output module receiving the control signal and the filtered sample signal, holding an output of the FIR filter according to the control signal when the number of modified iterations is completed, and adding a filtering operation result, obtained per modified iteration number, while the output of the FIR filter is being held to output a finally filtered sample signal according to the control signal.

2. The variable order short-term predictor of claim 1, wherein the filtered output result from the FIR filter is defined as Equation below:

$$\text{when } k \geq N,\ h_k = 0,\ L = \left[\frac{N}{T}\right]$$

$$y(n) = \sum_{k=0}^{N-1} h_k x(n-k)$$

$$y(n) = \sum_{l=0}^{L-1}\left(\sum_{k=0}^{T-1} h_{k+Tl} x(n-k-Tl)\right)$$

where y(n) is an output of the filter, x(n) is the sample signal, $h_k$ is a linear prediction coefficient, N is a prediction order, T is the number of FIR filter taps, and L is the number of modified iterations.

3. The variable order short-term predictor of claim 1, wherein the pre-decision module calculates and outputs a maximum integer value, which is obtained by dividing the prediction order by the minimum number of predetermined taps of the FIR filter, as the modified prediction order.

4. The variable order short-term predictor of claim 3, wherein the minimum number of predetermined taps of the FIR filter is sixteen.

5. The variable order short-term predictor of claim 1, wherein the FIR filter iteratively performs the filtering operation on the received sample signal according to radix-2 algorithm.

* * * * *